US010463911B2

(12) United States Patent
Chapman

(10) Patent No.: US 10,463,911 B2
(45) Date of Patent: Nov. 5, 2019

(54) PUSH-UP EXERCISE ENHANCEMENT DEVICE

(71) Applicant: Douglas Chapman, Bronx, NY (US)

(72) Inventor: Douglas Chapman, Bronx, NY (US)

( * ) Notice: Subject to any disclaimer, the term of this patent is extended or adjusted under 35 U.S.C. 154(b) by 135 days.

(21) Appl. No.: 15/837,875

(22) Filed: Dec. 11, 2017

(65) Prior Publication Data

US 2019/0175985 A1 Jun. 13, 2019

(51) Int. Cl.

*A63B 23/12* (2006.01)
*A63B 71/06* (2006.01)
*A63B 24/00* (2006.01)

(52) U.S. Cl.

CPC ..... *A63B 23/1236* (2013.01); *A63B 24/0062* (2013.01); *A63B 24/0087* (2013.01); *A63B 71/0622* (2013.01); *A63B 71/0686* (2013.01); *A63B 2220/17* (2013.01); *A63B 2220/801* (2013.01); *A63B 2220/833* (2013.01); *A63B 2225/093* (2013.01)

(58) Field of Classification Search

CPC ..... A63B 23/1236; A63B 24/0062; A63B 71/0686; A63B 24/0087; A63B 71/0622; A63B 2220/833; A63B 2220/801; A63B 2220/17; A63B 2225/093

See application file for complete search history.

(56) References Cited

U.S. PATENT DOCUMENTS

D363,442 S 10/1995 Mullinix
5,582,565 A 12/1996 Soria
6,129,651 A 10/2000 Denaro
6,663,547 B1 * 12/2003 Hughes ..... A61B 5/1072 482/141
7,476,187 B2 1/2009 Corte
D593,169 S 5/2009 Storch
7,588,521 B1 * 9/2009 Fazzari ..... A63B 21/06 482/141
7,905,816 B1 * 3/2011 Murphy ..... A63B 21/068 482/114
8,216,114 B1 * 7/2012 Wynn, III ..... A63B 23/0458 297/338
8,998,783 B2 4/2015 Orenstein
9,205,299 B1 * 12/2015 Hall ..... A63B 21/0552
9,452,318 B2 * 9/2016 Rowe ..... A63B 24/0003
9,675,829 B1 * 6/2017 Katz ..... A63B 1/00
2005/0130806 A1 * 6/2005 Lopez ..... A63B 21/00047 482/38
2010/0113225 A1 5/2010 Mills et al.
2010/0137105 A1 * 6/2010 McLaughlin ..... A63B 23/0205 482/8

(Continued)

*Primary Examiner* — Sundhara M Ganesan

(57) ABSTRACT

A push-up exercise enhancement device for verifying and counting push-ups includes a base. Each of a pair of rods is coupled to and extends perpendicularly from proximate to a respective opposing end of the base. Each rod comprises a plurality of nested sections so that the rods are selectively extensible. A plate is coupled to and extends between the rods distal from the base. The plate and the base define an upper limit and a lower limit for a proper push-up. A counter is operationally coupled to the base and the plate. The counter is configured to assess sequential contacts to the base and the plate by the torso of the user to determine the proper push-up and to display a count of the proper push-ups to the user.

16 Claims, 4 Drawing Sheets

(56) References Cited

U.S. PATENT DOCUMENTS

| | | | | |
|---|---|---|---|---|
| 2011/0275499 | A1 | 11/2011 | Eschenbach | |
| 2014/0357460 | A1* | 12/2014 | Sorace | A63B 23/1236 482/141 |
| 2014/0364288 | A1* | 12/2014 | Chuang | A63B 21/00069 482/122 |

* cited by examiner

PUSH-UP EXERCISE ENHANCEMENT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to exercise devices and more particularly pertains to a new exercise device for verifying and counting push-ups.

BRIEF SUMMARY OF THE INVENTION

An embodiment of the disclosure meets the needs presented above by generally comprising a base. Each of a pair of rods is coupled to and extends perpendicularly from proximate to a respective opposing end of the base. Each rod comprises a plurality of nested sections so that the rods are selectively extensible. A plate is coupled to and extends between the rods distal from the base. The plate and the base define an upper limit and a lower limit for a proper push-up. A counter is operationally coupled to the base and the plate. The counter is configured to assess sequential contacts to the base and the plate by the torso of the user to determine the proper push-up and to display a count of the proper push-ups to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
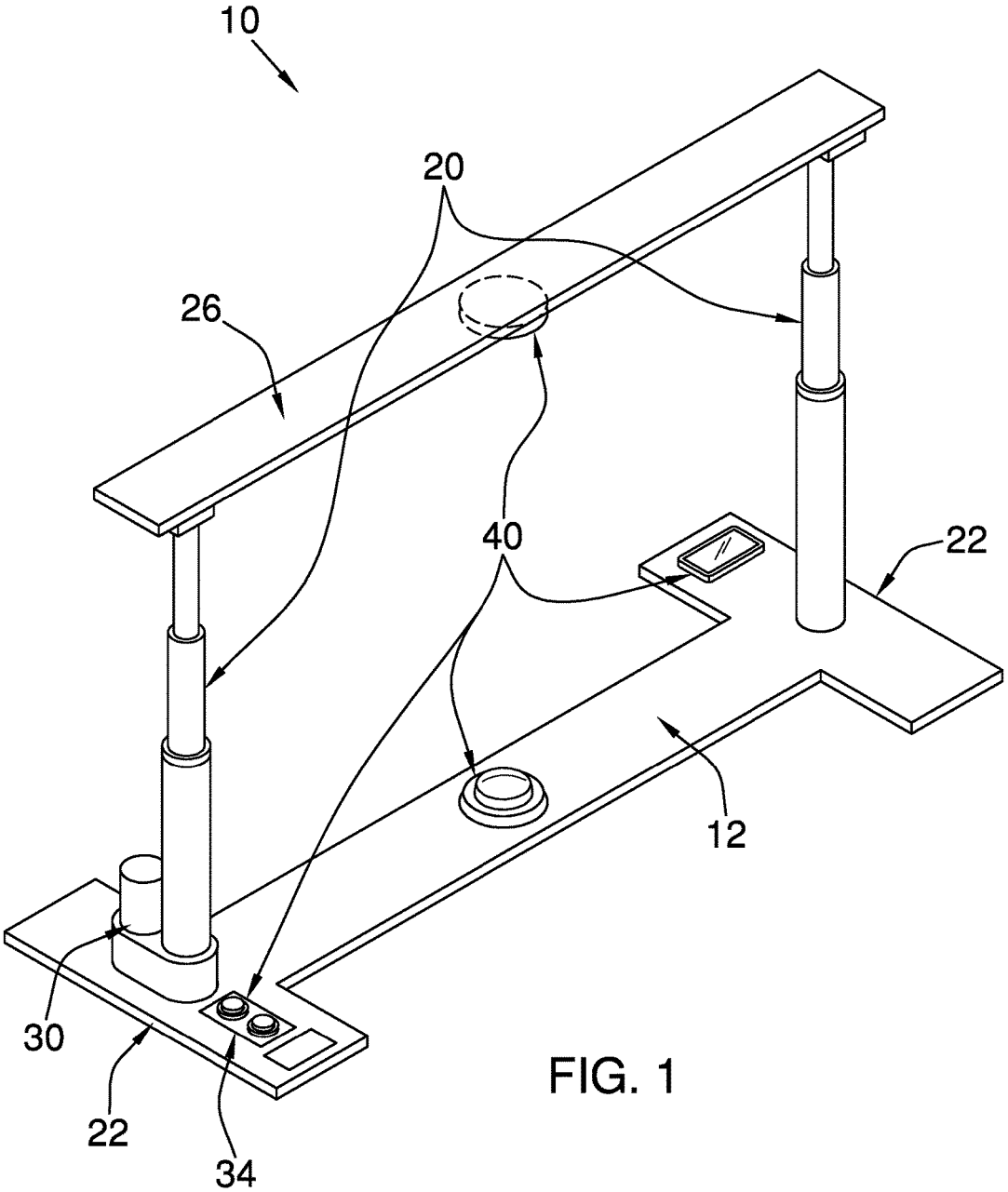
FIG. 1 is an isometric perspective view of a push-up exercise enhancement device according to an embodiment of the disclosure.
Figure 2:
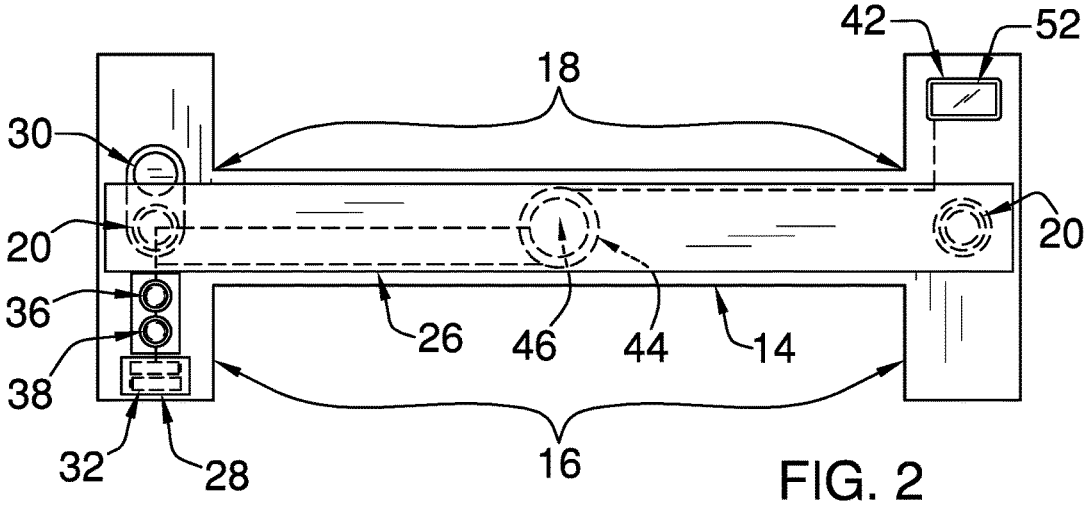
FIG. 2 is a top view of an embodiment of the disclosure.
Figure 3:
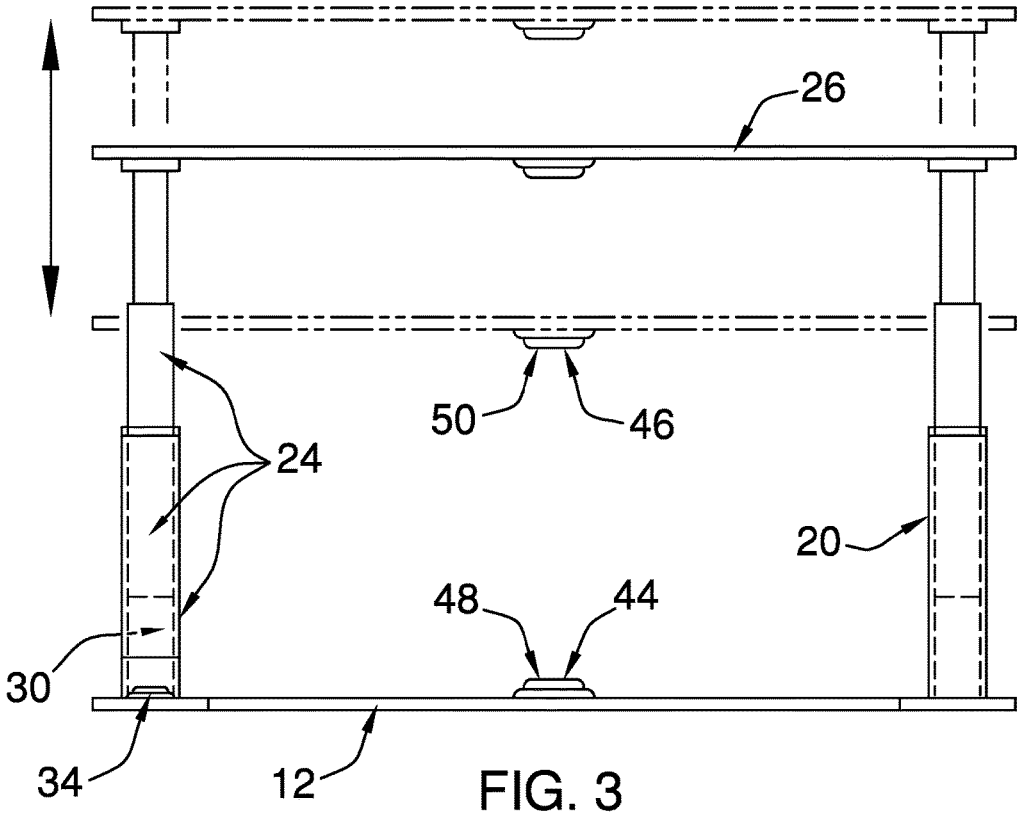
FIG. 3 is a side view of an embodiment of the disclosure.
Figure 4:
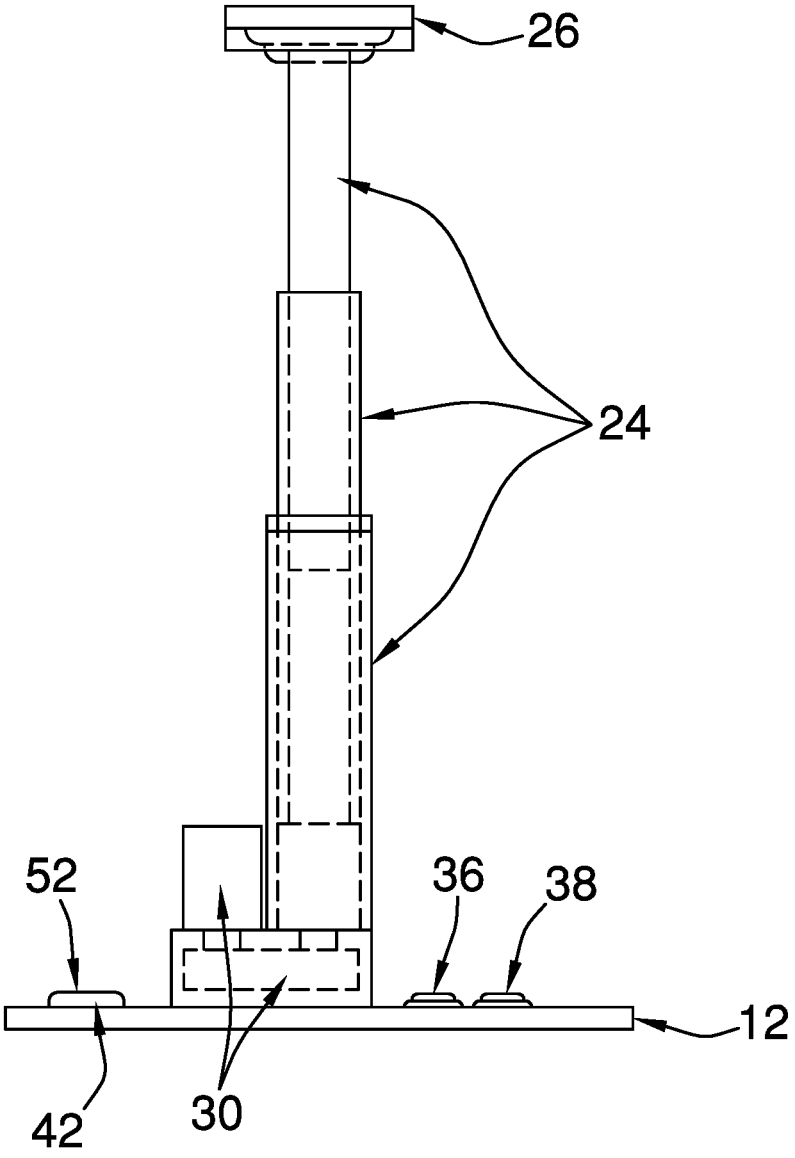
FIG. 4 is a cross-sectional view of an embodiment of the disclosure.
Figure 5:
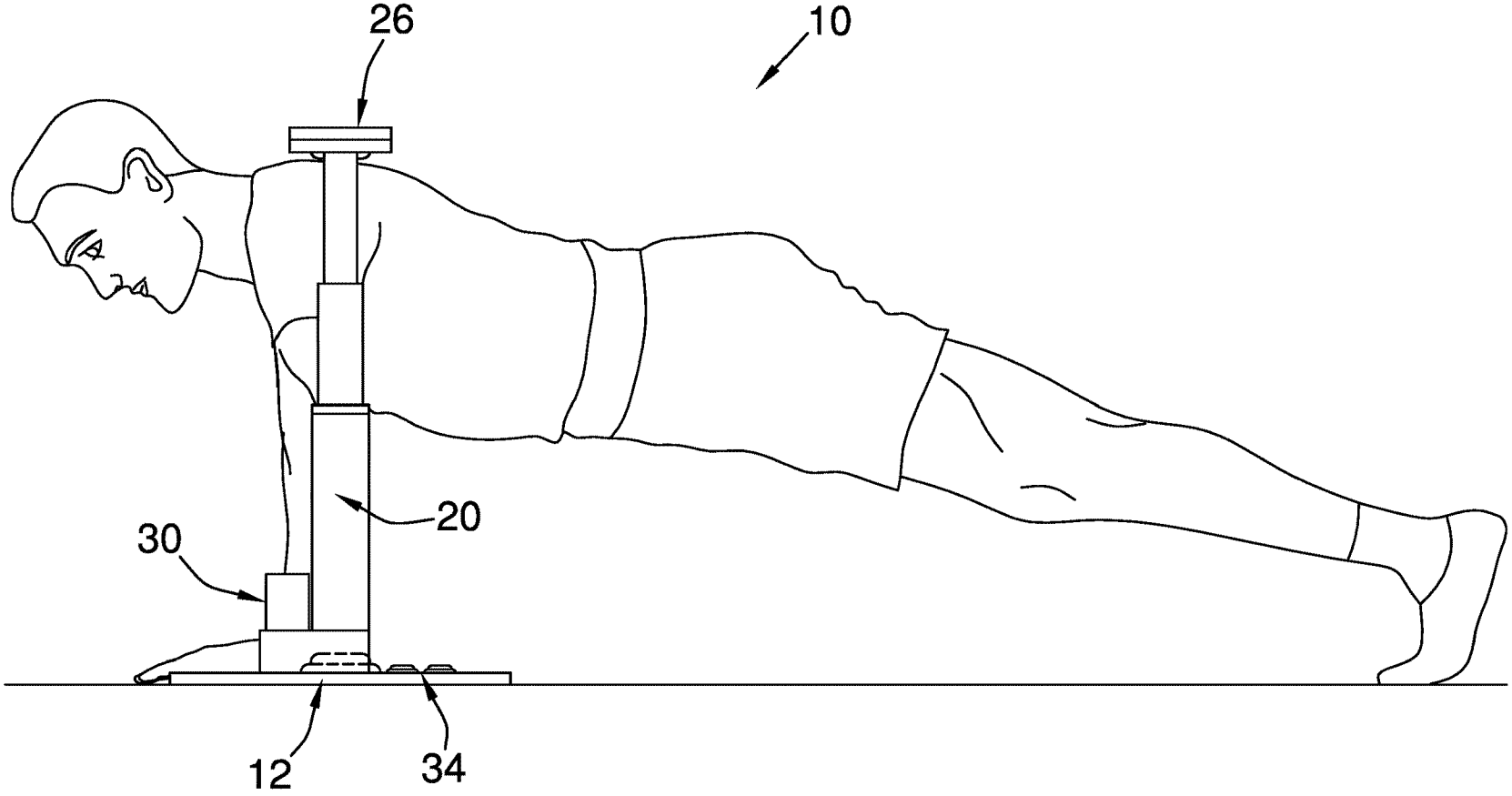
FIG. 5 is an in-use view of an embodiment of the disclosure.

With reference now to the drawings, and in particular to FIGS. 1 through 5 thereof, a new exercise device embodying the principles and concepts of an embodiment of the disclosure and generally designated by the reference numeral 10 will be described.

As best illustrated in FIGS. 1 through 5, the push-up exercise enhancement device 10 generally comprises a base 12. In an embodiment, the base 12 comprises a first panel 14 and a pair of second panels 16. The first panel 14 is elongated rectangularly shaped. The second panels 16 are rectangularly shaped. Each second panel 16 is coupled to a respective opposing edge 18 of the first panel 14 so that the base 12 is I-shaped.

Each of a pair of rods 20 is coupled to and extends perpendicularly from proximate to a respective opposing end 22 of the base 12. Each rod 20 comprises a plurality of nested sections 24 so that the rods 20 are selectively extensible. In one embodiment, the plurality of nested sections 24 comprises three nested sections 24. In another embodiment, the rods 20 are circularly shaped when viewed longitudinally.

A plate 26 is coupled to and extends between the rods 20 distal from the base 12. The rods 20 are configured to selectively position the plate 26 relative to the base 12. The plate 26 and the base 12 are configured to define an upper limit and a lower limit for a proper push-up. The plate 26 is elongated and rectangular shaped.

A power module 28 and an actuator 30 are coupled to the base 12. The actuator 30 is operationally coupled to the pair of rods 20 and the power module 28. The actuator 30 is linear type. The actuator 30 is positioned to selectively induce extension and retraction of the rods 20. In one embodiment, the power module 28 comprises at least one battery 32.

A controller 34 is coupled to the base 12. The controller 34 is operationally coupled to the power module 28 and the actuator 30. The controller 34 is positioned to selectively couple the actuator 30 to the power module 28 to selectively induce extension and retraction of the rods 20. In one embodiment, the controller 34 is positioned proximate to a respective opposing end 22 of the base 12.

The controller 34 comprises a first button 36 and a second button 38. The first button 36 and the second button 38 are depressible. The first button 36 is configured to be depressed to couple the actuator 30 to the power module 28 to induce extension of the rods 20. The first button 36 is configured to be released to decouple the actuator 30 from the power module 28 to fixedly position the rods 20. The second button 38 is configured to be depressed to couple the actuator 30 to the power module 28 to induce retraction of the rods 20. The second button 38 is configured to be released to decouple the actuator 30 from the power module 28 to fixedly position the rods 20.

A counter 40 is operationally coupled to the base 12 and the plate 26. The counter 40 is configured to assess sequential contacts to the base 12 and the plate 26 by the torso of the user to determine the proper push-up. The counter 40 also is configured to present a count of the proper push-ups to the user.

The counter 40 comprises a microprocessor 42 that is coupled to the base 12. The microprocessor 42 is operationally coupled to the power module 28. A first sensor 44 is coupled to the base 12. A second sensor 46 is coupled to the plate 26. The first sensor 44 and the second sensor 46 are operationally coupled to the microprocessor 42. The first sensor 44 is configured to sense contact with a chest of the user and to communicate the contact to the microprocessor 42. The second sensor 46 is configured to sense contact with a back of the user and to communicate the contact to the microprocessor 42. The microprocessor 42 is positioned to assess sequential contacts to the first sensor 44 and the second sensor 46 to determine the proper push-up and the count of the proper push-ups.

The first sensor 44 and the second sensor 46 are positioned equally distant from the rods 20. In yet another embodiment, the first sensor 44 comprises a first impact sensor 48 and the second sensor 46 comprises a second impact sensor 50.

A display 52 is coupled to the base 12. The display 52 is operationally coupled to the microprocessor 42. The microprocessor 42 is positioned to induce the display 52 to present the count of the proper push-ups to the user. In one embodiment, the display 52 is configured to present a time that corresponds to the time from a first proper push-up to a final proper push-up. The microprocessor 42 is positioned to induce the display 52 to present the time that corresponds to the time from the first proper push-up to the final proper push-up to the user. The display 52 is positioned proximate to a respective opposing end 22 of the base 12.

In use, the first button 36 is configured to be depressed to couple the actuator 30 to the power module 28 to induce extension of the rods 20. The first button 36 is configured to be released to decouple the actuator 30 from the power module 28 to fixedly position the rods 20. The second button 38 is configured to be depressed to couple the actuator 30 to the power module 28 to induce retraction of the rods 20. The second button 38 is configured to be released to decouple the actuator 30 from the power module 28 to fixedly position the rods 20.

The plate 26 and the base 12 are configured to define an upper limit and a lower limit for the proper push-up. The first sensor 44 and the second sensor 46 are configured to sense contacts to the first sensor 44 and the second sensor 46 by the chest and the back of the user. The first sensor 44 and the second sensor 46 are configured to communicate the contacts to the microprocessor 42. The microprocessor 42 is positioned to assess sequential contacts to the first sensor 44 and the second sensor 46 to determine the proper push-up and the count of the proper push-ups. The microprocessor 42 is positioned to induce the display 52 to present the count of the proper push-ups. The microprocessor 42 also is positioned to induce the display 52 to present the time that corresponds to the time from the first proper push-up to the final proper push-up to the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A push-up exercise enhancement device comprising:

a base;

a pair of rods, each said rod being coupled to and extending perpendicularly from proximate to a respective opposing end of said base, each said rod comprising a plurality of nested sections such that said rods are selectively extensible;

a plate coupled to and extending between said rods distal from said base;

a counter operationally coupled to said base and said plate, said counter being configured for assessing sequential contacts to said base and said plate by the torso of the user for determining a proper push-up and for displaying a count of the proper push-ups to the user; and wherein said plate is positioned on said rods such that said rods are configured for selectively positioning said plate relative to said base such that said plate and said base are configured for defining an upper limit and a lower limit for the proper push-up, wherein said counter is positioned on said base and said plate such that said counter is configured for determining the proper push-up and for displaying the count of the proper push-ups to the user.

2. The device of claim 1, further including said base comprising a first panel and a pair of second panels, said first panel being elongated rectangularly shaped, said second panels being rectangularly shaped, each said second panel being coupled to a respective opposing edge of said first panel such that said base is I-shaped.

3. The device of claim 1, further including said plurality of nested sections comprising three said nested sections.

4. The device of claim 1, further including said rods being circularly shaped when viewed longitudinally.

5. The device of claim 1, further including said plate being elongated rectangularly shaped.

6. The device of claim 1, further comprising:

a power module coupled to said base;

an actuator coupled to said base, said actuator being linear type, said actuator being operationally coupled to said pair of rods and said power module; and wherein said actuator is positioned on said base such that said actuator is positioned for selectively inducing extension and retraction of said rods.

7. The device of claim 6, further including said power module comprising at least one battery.

8. The device of claim 6, further including a controller coupled to said base, said controller being operationally coupled to said power module and said actuator, wherein said controller is positioned on said base such that said controller is positioned for selectively coupling said actuator to said power module for selectively inducing extension and retraction of said rods.

9. The device of claim 8, further including said controller being positioned proximate to a respective said opposing end of said base.

10. The device of claim 8, further including said controller comprising a first button and a second button, said first button and said second button being depressible, wherein said first button is positioned on said base such that said first button is configured for depressing for coupling said actuator to said power module for inducing extension of said rods and for releasing for decoupling said actuator from said power module for fixedly positioning said rods, wherein said second button is positioned on said base such that said second button is configured for depressing for coupling said actuator to said power module for inducing retraction of said rods and for releasing for decoupling said actuator from said power module for fixedly positioning said rods.

11. The device of claim 6, further including said counter comprising:

a microprocessor coupled to said base, said microprocessor being operationally coupled to said power module;

a first sensor coupled to said base, said first sensor being operationally coupled to said microprocessor, said first sensor being configured for sensing contact with a chest of the user and for communicating the contact to said microprocessor;

a second sensor coupled to said plate, said second sensor being operationally coupled to said microprocessor, said second sensor being configured for sensing contact with a back of the user and for communicating the contact to said microprocessor;

a display coupled to said base, said display being operationally coupled to said microprocessor; and wherein said first sensor and said second sensor are positioned on said base and said plate, respectively, such that said first sensor and said second sensor are configured for sensing contacts to said first sensor and said second sensor by the chest and the back of the user and for communicating the contacts to said microprocessor such that said microprocessor is positioned for assessing sequential contacts to said first sensor and said second sensor for determining the proper push-up and the count of the proper push-ups, wherein said display is positioned on said base such that said microprocessor is positioned for inducing said display for presenting the count of the proper push-ups to the user.

12. The device of claim 11, further including said display being configured for presenting a time corresponding to the time from a first proper push-up to a final proper push-up.

13. The device of claim 11, further including said first sensor and said second sensor being positioned equally distant from said rods.

14. The device of claim 11, further including said first sensor comprising a first impact sensor, said second sensor comprising a second impact sensor.

15. The device of claim 11, further including said display being positioned proximate to a respective said opposing end of said base.

16. A push-up exercise enhancement device comprising:

a base, said base comprising a first panel and a pair of second panels, said first panel being elongated rectangularly shaped, said second panels being rectangularly shaped, each said second panel being coupled to a respective opposing edge of said first panel such that said base is I-shaped;

a pair of rods, each said rod being coupled to and extending perpendicularly from proximate to a respective opposing end of said base, each said rod comprising a plurality of nested sections such that said rods are selectively extensible, said plurality of nested sections comprising three said nested sections, said rods being circularly shaped when viewed longitudinally;

a plate coupled to and extending between said rods distal from said base, wherein said plate is positioned on said rods such that said rods are configured for selectively positioning said plate relative to said base such that said plate and said base are configured for defining an upper limit and a lower limit for a proper push-up, said plate being elongated rectangularly shaped;

a power module coupled to said base, said power module comprising at least one battery;

an actuator coupled to said base, said actuator being linear type, said actuator being operationally coupled to said pair of rods and said power module, wherein said actuator is positioned on said base such that said actuator is positioned for selectively inducing extension and retraction of said rods;

a controller coupled to said base, said controller being operationally coupled to said power module and said actuator, wherein said controller is positioned on said base such that said controller is positioned for selectively coupling said actuator to said power module for selectively inducing extension and retraction of said rods, said controller being positioned proximate to a respective said opposing end of said base, said controller comprising a first button and a second button, said first button and said second button being depressible, wherein said first button is positioned on said base such that said first button is configured for depressing for coupling said actuator to said power module for inducing extension of said rods and for releasing for decoupling said actuator from said power module for fixedly positioning said rods, wherein said second button is positioned on said base such that said second button is configured for depressing for coupling said actuator to said power module for inducing retraction of said rods and for releasing for decoupling said actuator from said power module for fixedly positioning said rods;

a counter operationally coupled to said base and said plate, said counter being configured for assessing sequential contacts to said base and said plate by the torso of the user for determining the proper push-up and for displaying a count of the proper push-ups to the user, wherein said counter is positioned on said base and said plate such that said counter is configured for determining the proper push-up and for displaying the count of the proper push-ups to the user, said counter comprising:

a microprocessor coupled to said base, said microprocessor being operationally coupled to said power module, a first sensor coupled to said base, said first sensor being operationally coupled to said microprocessor, said first sensor being configured for sensing contact with a chest of the user and for communicating the contact to said microprocessor, said first sensor being positioned equally distant from said rods, said first sensor comprising a first impact sensor, a second sensor coupled to said plate, said second sensor being operationally coupled to said microprocessor, said second sensor being configured for sensing contact with a back of the user and for communicating the contact to said microprocessor, wherein said first sensor and said second sensor are positioned on said base and said plate, respectively, such that said first sensor and said second sensor are configured for sensing contacts to said first sensor and said second sensor by the chest and the back of the user and for communicating the contacts to said microprocessor such that said microprocessor is positioned for assessing sequential contacts to said first sensor and said second sensor for determining the proper push-up and the count of the proper push-ups, said second sensor being positioned equally distant from said rods, said second sensor comprising a second impact sensor, and a display coupled to said base, said display being operationally coupled to said microprocessor, wherein said display is positioned on said base such that said microprocessor is positioned for inducing said display for presenting the count of the proper push-ups to the user, said display being configured for presenting a time corresponding to the time from a first proper push-up to a final proper push-up, said display being positioned proximate to a respective said opposing end of said base; and wherein said first button is positioned on said base such that said first button is configured for depressing for coupling said actuator to said power module for inducing extension of said rods and for releasing for decoupling said actuator from said power module for fixedly positioning said rods, wherein said second button is positioned on said base such that said second button is configured for depressing for coupling said actuator to said power module for inducing retraction of said rods and for releasing for decoupling said actuator from said power module for fixedly positioning said rods, such that said plate and said base are configured for defining the upper limit and the lower limit for the proper push-up, wherein said first sensor and said second sensor are positioned on said base and said plate, respectively, such that said first sensor and said second sensor are configured for sensing contacts to said first sensor and said second sensor by the chest and the back of the user and for communicating the contacts to said microprocessor such that said microprocessor is positioned for assessing the sequential contacts to said first sensor and said second sensor for determining the proper push-up and the count of the proper push-ups, wherein said display is positioned on said base such that said microprocessor is positioned for inducing said display for presenting the count of the proper push-ups and the time corresponding to the time from the first proper push-up to the final proper push-up to the user.

* * * * *